US009221588B2

(12) United States Patent
Ruth

(10) Patent No.: US 9,221,588 B2
(45) Date of Patent: Dec. 29, 2015

(54) SLIDER DEVICE DISPLAY PACKAGE

(75) Inventor: James Ruth, Miami, FL (US)

(73) Assignee: TracFone Wireless, Inc., Miami, FL (US)

( * ) Notice: Subject to any disclaimer, the term of this patent is extended or adjusted under 35 U.S.C. 154(b) by 745 days.

(21) Appl. No.: 12/825,332

(22) Filed: Jun. 28, 2010

(65) Prior Publication Data

US 2011/0100847 A1 May 5, 2011

Related U.S. Application Data

(63) Continuation-in-part of application No. 29/316,815, filed on Nov. 4, 2009, now Pat. No. Des. 636,669.

(51) Int. Cl.

| | |
|---|---|
| ***B65D 85/00*** | (2006.01) |
| ***B65D 75/22*** | (2006.01) |
| ***B65D 81/133*** | (2006.01) |

(52) U.S. Cl.

CPC ..... *B65D 75/22* (2013.01); *B65D 81/133* (2013.01)

(58) Field of Classification Search

USPC ..... 206/467, 469, 470, 471, 320, 576

See application file for complete search history.

(56) References Cited

U.S. PATENT DOCUMENTS

| | | | | |
|---|---|---|---|---|
| 3,298,515 | A | | 1/1967 | Watts, Jr. |
| 3,463,309 | A | | 8/1969 | Szostek |
| 3,497,059 | A | | 2/1970 | Watts, Jr. |
| 3,533,503 | A | | 10/1970 | Wood |
| 3,645,384 | A | | 2/1972 | Wind |
| 4,016,972 | A | | 4/1977 | Szamborski |
| 4,020,694 | A | | 5/1977 | Mayhew |
| 4,361,226 | A | | 11/1982 | Travis |
| 4,383,607 | A | | 5/1983 | Lordahl et al. |
| 4,449,629 | A | | 5/1984 | Barrieau |
| 4,499,353 | A | | 2/1985 | Shields |
| 4,512,474 | A | | 4/1985 | Harding |
| D283,489 | S | | 4/1986 | Stevens |
| D291,064 | S | | 7/1987 | Haber et al. |
| 4,749,082 | A | | 6/1988 | Gardiner et al. |
| 4,778,056 | A | | 10/1988 | Faulstick et al. |
| 4,804,984 | A | | 2/1989 | Heuer et al. |
| 4,848,541 | A | | 7/1989 | Paliotta et al. |
| D305,408 | S | | 1/1990 | LaJoie |
| D307,554 | S | | 5/1990 | McAlister, Sr. |
| 4,976,354 | A | | 12/1990 | Levy |
| 5,076,432 | A | | 12/1991 | Wolf et al. |
| 5,156,276 | A | | 10/1992 | Lebowitz |
| 5,297,679 | A | * | 3/1994 | Rondone et al. ..... 206/468 |
| 5,407,066 | A | | 4/1995 | Grange |
| 5,529,174 | A | | 6/1996 | McQueeny |
| 5,626,226 | A | | 5/1997 | Gardiner et al. |
| 5,685,429 | A | | 11/1997 | Myers |
| D394,004 | S | | 5/1998 | Tate |

(Continued)

*Primary Examiner* — Jacob K Ackun

(74) *Attorney, Agent, or Firm* — Baker & Hostetler LLP

(57) ABSTRACT

A display package for slider phones devices, comprising an outer cover package having a front section molded to conform to the front surface of the slider phone in the open position, and an inner tray molded to conform to the back surface of the slider device in the open position. The inner tray is contained within the outer cover package and the outer cover package is closed with the molded front section located over the front surface of the slider device, packaging the device securely in the open position. Another embodiment comprises a recessed inner tray conforming to the back side of the slider device in the open position and a molded retainer placed between the front surface of the slider phone in the open position and a flat front outer cover package.

14 Claims, 5 Drawing Sheets

(56) References Cited

U.S. PATENT DOCUMENTS

| | | | | |
|---|---|---|---|---|
| 5,758,777 | A | 6/1998 | Dods | |
| 5,772,031 | A | 6/1998 | Landis | |
| 5,850,916 | A | 12/1998 | Pettersson et al. | |
| 5,954,203 | A | 9/1999 | Marconi | |
| 5,967,327 | A | 10/1999 | Jones | |
| 6,039,495 | A | 3/2000 | Zimmerman et al. | |
| 6,047,833 | A | 4/2000 | Salomon | |
| 6,059,106 | A | 5/2000 | Baker et al. | |
| 6,170,659 | B1 | 1/2001 | Hunter | |
| 6,199,697 | B1 | 3/2001 | Dirx | |
| 6,216,866 | B1 * | 4/2001 | Schoenberg | 206/320 |
| 6,286,679 | B1 | 9/2001 | Dirx | |
| 6,311,837 | B1 | 11/2001 | Blaustein et al. | |
| D466,405 | S | 12/2002 | Lee | |
| 6,520,337 | B2 * | 2/2003 | Smith | 206/592 |
| D471,442 | S | 3/2003 | Lee | |
| 6,588,596 | B1 | 7/2003 | Holmes et al. | |
| D496,268 | S | 9/2004 | Stamm et al. | |
| D499,963 | S | 12/2004 | Church | |
| D509,727 | S | 9/2005 | Suckle et al. | |
| D517,907 | S | 3/2006 | Lee et al. | |
| D521,860 | S | 5/2006 | Lee et al. | |
| D534,795 | S | 1/2007 | Manuel et al. | |
| 7,180,735 | B2 | 2/2007 | Thomas et al. | |
| 7,207,440 | B2 | 4/2007 | Briscoe | |
| D541,646 | S | 5/2007 | Hayes et al. | |
| 7,213,709 | B2 | 5/2007 | Moskovich et al. | |
| D553,973 | S | 10/2007 | Geurts et al. | |
| 7,281,630 | B2 * | 10/2007 | Hartman et al. | 206/467 |
| 7,296,679 | B2 | 11/2007 | Lam | |
| 7,328,803 | B2 | 2/2008 | Yamazaki et al. | |
| 7,353,948 | B1 | 4/2008 | McDonald | |
| 7,410,056 | B2 | 8/2008 | Cafferata et al. | |
| 7,494,015 | B2 * | 2/2009 | Bacon et al. | 206/778 |
| 7,520,389 | B2 | 4/2009 | Lalouette | |
| D593,404 | S | 6/2009 | Lee | |
| D605,501 | S | 12/2009 | Pham et al. | |
| 7,878,326 | B2 * | 2/2011 | Andre et al. | 206/320 |
| 8,534,463 | B2 * | 9/2013 | Smith | 206/775 |
| 8,573,397 | B1 * | 11/2013 | Fager et al. | 206/469 |
| 2001/0007308 | A1 * | 7/2001 | Glassman | 206/469 |
| 2004/0079668 | A1 * | 4/2004 | Lee | 206/471 |
| 2005/0072691 | A1 | 4/2005 | Schlansky | |
| 2006/0186011 | A1 * | 8/2006 | Palmer | 206/461 |
| 2006/0278551 | A1 * | 12/2006 | Bianchini et al. | 206/463 |
| 2007/0151899 | A1 * | 7/2007 | Chun | 206/775 |
| 2008/0185312 | A1 * | 8/2008 | Geurts et al. | 206/525 |
| 2008/0245694 | A1 * | 10/2008 | Shibata et al. | 206/470 |
| 2010/0155277 | A1 * | 6/2010 | Koch | 206/320 |
| 2010/0314279 | A1 * | 12/2010 | Hansen et al. | 206/470 |

* cited by examiner

SLIDER DEVICE DISPLAY PACKAGE

CONTINUITY/PRIORITY INFORMATION

This application is a continuation in part of co-pending U.S. Design patent application Ser. No. 29/316,815 filed on Nov. 4, 2009, as well as co-pending U.S. Design patent application Ser. No. 29/316,816 filed on Nov. 4, 2009 as well as co-pending U.S. Design patent application Ser. No. 29/316,817 filed on Nov. 4, 2009, the entirety of each of which applications is incorporated herein by reference. The benefit of the earlier filing date of each of co-pending U.S. Design patent application Ser. No. 29/316,815 filed on Nov. 4, 2009, as well as co-pending U.S. Design patent application Ser. No. 29/316,816 filed on Nov. 4, 2009 as well as co-pending U.S. Design patent application Ser. No. 29/316,817 filed on Nov. 4, 2009 is claimed pursuant to 35 U.S.C. Section 120.

COPYRIGHT NOTICE

A portion of the disclosure of this patent document contains material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD OF THE INVENTION

The present invention relates to packaging for goods. More specifically, the present invention relates to display packaging for consumer goods such as electronic communications devices, particularly mobile communications devices having sliding components, and more particularly cellular phones and other mobile communications devices having a slider-type configuration.

BACKGROUND OF THE INVENTION

A slider-type electronic communications device is composed of usually two, but sometimes more, segments that slide relative to each other via a sliding mechanism. Slider-type configurations allow the particular electronic communications device to provide full physical keyboards or keypads without sacrificing portability by retracting them into the device when these are not in use. Slider-type electronic communication devices, such as, for example, phones, personal digital assistants or other texting and email communication devices, generally are configured to have a first segment, referred to here as an upper segment, which is typically a display segment which houses a speaker used for audio/voice output and a display screen, and a second segment, referred to here as a lower segment, which provides a keypad or keyboard and slides out relative to the first segment for use. The two segments typically slide relative to each other via rail and track mechanism. In some such devices the upper portion is a cover and the lower portion is the user interface such as a keyboard or touch screen. In still other such devices such as slider-type cellular phones, the upper portion is a display screen and includes keys to dial the phone or the display screen itself is a touch screen displaying keys to dial the phone, and the lower portion is a keyboard such as a traditionally configures "qwerty" keyboard with keys representing numbers, letters and/or other symbols for typing text. Such devices can have various other configurations, with components such as those described above disposed in either the upper or lower portions of said devices. Some slider-type devices have the sliding mechanism configured to slide the device segments in a horizontal or side-to-side manner relative to the device's regular use position, while others have the sliding mechanism configured to slide the device segments in a vertical or up/down manner relative to the device's regular use position. Examples of slider phones include the SL55 phone made by Siemens, the LX260 phone made by LG and the T301G and A877 phones made by Samsung, among numerous other slider-type phones. Some slider phones utilize two-way slider mechanisms that provide unique functions depending on which direction the segments slide relative to eachother, such as the N85 phone made by Nokia. What is common to all such devices is a sliding mechanism that allows two or more segments or portions of the device to slide in relation to each other to reveal additional elements of the device. Such devices are typically carried or stored in the closed position, which refers to the position in which the portions of the device are positioned one on top of the other and the sliding mechanism is in a retracted state. When in use the portions can be slid relative to eachother via a sliding mechanism to a position in which the portions are not one on top of the other, so that the features or elements of the lower portion(s) can be utilized. For example, in slider-type phones, the upper portion typically has a display screen and keys to dial the phone and perform other functions, and the lower portion has a "qwerty" type keyboard for use in texting. The sliding mechanism allows the top portion to be moved by sliding to reveal the bottom keyboard portion.

The present invention is a display package for slider-type devices that packages the slider-type device with the sliding segments retained in the open position, i.e., in the position in which the sliding segments are slid away relative to eachother such that the sliding segments are not one on top of the other (such that the back surface of one segment blocks the front surface of the other segment from view) to reveal the front surface of the lower segment or otherwise revealing the front surface of each of the sliding segments.

SUMMARY OF THE INVENTION

The present invention is a display package for mobile communications devices having sliding components and more particularly cellular phones and other mobile communications devices having a slider-type configuration, such as, without limitation, slider-type cell phones or personal digital assistants.

In one preferred embodiment, the display package has an outer cover package component and an inner tray component that each have a section that is molded or is otherwise shaped to generally or substantially conform to the front side and back side, respectively, of all or part of the slider device in its open position, such that when the slider device is inserted in its open position into the front surface of the recess of the inner tray that is created by such molding or other shaping, and the inner tray is placed within the outer cover package and the outer cover package is closed over the inner tray with the shaped surface of the outer cover package that generally or substantially conforms to the front surface of the slider device in the open position is located over the front surface of the slider device, the slider device is retained securely packaged in the open position and is prevented from closing during shipment. The inner tray and the outer cover package can be molded, shaped or otherwise contoured to generally or substantially conform to the shape of either or both of the slider device sliding segments from the bottom side and top side, respectively.

In another preferred embodiment, the display package also uses an outer cover package component and inner tray component but instead of (or in alternate embodiments, in addition to) the outer cover package and inner tray both having sections that are molded or otherwise shaped to generally or substantially conform to the front and back sides, respectively, of the slider device in its open position, the front surface of the inner tray has a section that is molded to provide a recess shaped to generally or substantially conform to the back side of the slider device when in its open position to hold the slider device in place when the back side of the slider device in the open position is placed thereon, but the outer cover package front surface can preferably be substantially flat rather than having a section that is molded to generally or substantially conform to the slider device front surface open position shape, and instead this embodiment of the display package further includes a retainer insert that is placed between the front surface of the lower segment of the slider phone in the open position and the front inner surface of the outer cover package section located over the slider phone and the recess in the inner tray, to keep the slider phone securely packaged in the open position. In this second embodiment the outer cover package front surface does not have to be substantially flat, and can still have a contoured front surface generally or substantially conforming to the shape of all or a portion of the front side of the slider device, and is not limited by the outer cover package configuration, the retention of the slider device in the open position being accomplished by a retainer insert. The retainer insert has a first side wall that is preferably shaped to generally or substantially conform to the shape of the bottom edge of the upper sliding segment and another sidewall located opposite to said first side wall that is preferably shaped to generally or substantially conform to the edge of the recess of the inner tray that rests against the bottom edge of the lower sliding segment when the slider device is placed in said recess.

DESCRIPTION OF A PREFERRED EMBODIMENT

Figure 1:
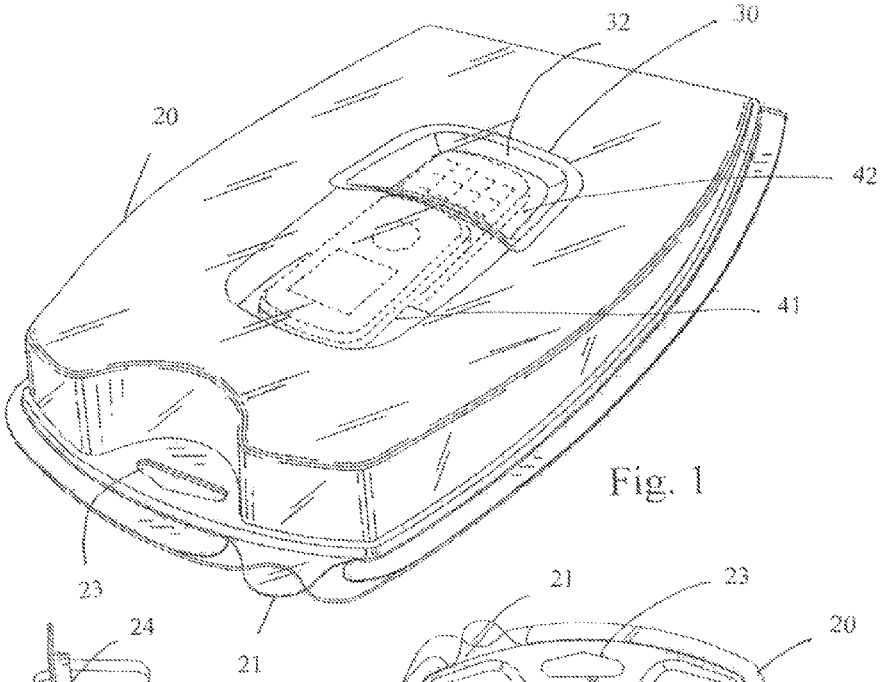
FIG. 1 is a top front assembled perspective view of the present invention in a preferred embodiment which includes a retainer insert, showing the inner tray having a shaped recess generally or substantially conforming to the back surface of the slider phone, with the slider phone resting thereon, the inner tray contained within the outer cover package with the outer cover package in closed position and the retainer insert installed over the front portion of the inner tray over the front surface of the lower segment of the slider phone and inside of the outer cover package.

The present invention, in a preferred embodiment, is a display package for packaging a slider-type electronic communications device in an open position with a first sliding segment and a second sliding segment slid apart relative to each other and the front side of said first and second sliding segments being visible, comprising an inner tray having a front side surface with a recess thereon contoured to generally or substantially conform to the shape of a first sliding segment of a said slider-type electronic communications device (or contoured to generally or substantially conform to the shape of all or part of the entire back side of the slider device in the open position) for receiving said back side of said first sliding segment of said slider-type electronic communications device (or receiving all or part of the entire back side of the slider-type device in the open position), an outer cover package having a front side surface with a section contoured to generally or substantially conform to the shape of a second sliding segment of said slider-type electronic communications device (or contoured to generally or substantially conform to the shape of all or part of the entire front side of the slider device in the open position) for placement over said front side of said second sliding segment of said slider-type electronic communications device (or for placement over all or part of the entire front side of the slider device in the open position), said inner tray being encloseable within said outer cover package and receiving in said recess said back side of said first sliding segment of said slider-type electronic communications device (or receiving all or part of the entire back side of the slider device in the open position), and said recess of said inner tray and said contoured front section of said outer cover package being positioned relative to eachother such that said contoured front section of said outer cover package fits generally snugly or closely over said front side of said second sliding segment of said slider-type electronic communications device when said slider-type electronic communications device is in the open position (or fitting generally snugly or closely over all or part of the entire front side of the slider device in the open position), thereby retaining the slider device in the open position within the package such that the two segments are slid apart relative to each other and their respective front surfaces are visible. In another preferred embodiment, the present invention is a display package for packaging a slider-type electronic communications device, said slider-type electronic communications device having a first sliding segment, a second sliding segment in sliding engagement relative to or with said first sliding segment, said first segment and said second segment each having front sides, back sides and side edges, said display package retaining said slider-type electronic communications device in an open position with first and second sliding segments slid apart relative to eachother and the front side of said first and second sliding segments being visible, comprising an inner tray having a front surface with a recess contoured to conform generally or substantially to the shape of at least the first sliding segment of a said slider-type electronic communications device for receiving said back side of at least said first sliding segment of said slider-type electronic communications device, an outer cover package for enclosing said inner tray and having a front section positioned over said slider-type electronic communications device when said device is placed in said recess of said inner tray and said outer cover package encloses said inner tray, and a retainer insert having a first side wall contoured to generally or substantially conform to and fit against a said side edge of said second segment of said slider-type electronic communications device which is adjacent to said first segment of said slider-type electronic communications device when said slider-type electronic communications device is in the open position, and having a second side wall disposed opposite said first side wall contoured to generally or substantially conform to and fit against said recess of said inner tray, said retainer insert being insertable over said front surface of said first segment of said slider-type electronic communications device when said slider-type electronic communications device is in the open position, and said inner tray being encloseable within said outer cover package and receiving in said recess said back side of said first sliding segment of said slider-type electronic communications device such that said retainer insert is positioned between said front surface of said first sliding segment of said slider-type electronic communications device and said front section of said outer cover package thereby maintaining said slider-type electronic communications device in the open position with first and second sliding segments slid apart relative to eachother and the front side of said first and second sliding segments being visible (and visible from outside the display package in a preferred embodiment which utilizes a transparent outer cover package and retainer insert). The display package of the present invention can be utilized with any slider-type electronic communications devices such as, without limitation, cellular phones, personal digital assistants, texting and email devices and other communications devices that have a slider-type mechanism whereby two or more segments of the device slide relative to eachother. As noted above, in one preferred embodiment, the display package comprises an inner tray which has a section that is molded or is otherwise shaped to provide an upper surface that generally or substantially conforms to the shape of the back side surface of particular slider-type electronic communications device when said device is in the open position, i.e., with the lower sliding segment and the upper sliding segment are slid in opposite directions relative to eachother. The inner tray molding has, in a preferred embodiment, a recess created by such molding or other shaping to hold the back side of the slider device, although it can be a raised portion rather than a recess. The recess or raised portion can be in the form of a single recess or raised portion shaped to accept the back side of the upper or lower segment of the slider device only. In that embodiment the outer cover package has a similar front surface recess or raised portion to accept the front side of the upper or lower segment and the recess/raised portion in the inner tray and the recess/raised portion in the outer cover package are configured to match the position of the upper and lower segments of the slider device in the open position. In an alternate embodiment, the recess or raised portion in the front of the inner tray can be in a "step" configuration, with a lower step and an upper step, the lower step shaped to accept the back side of the lower segment of the slider device and the upper step shaped to accept the back side of the upper segment of the slider device when the slider device is in the open position. The inner tray is preferably made of plastic but can be made of other suitable materials known in the art, such as, without limitation, cardboard, styrofoam, pressed paper, fiberglass or other plastic or fibrous materials or combinations of any suitable materials. The inner tray can also be a single piece component or it can be a multipart component. In a preferred embodiment, the inner tray has two halves-a front half and a back half, which can be fitted or coupled together via mating grooves or other coupling configuration disposed along their respective edges. Manuals, chargers and other slider device accessories can be packaged inside the inner tray in the space enclosed by the two inner tray halves. The inner tray components can each be made of the same material or different components can be made from different materials. The inner tray can also be transparent or opaque. Portions can be transparent while other portions can be opaque. The shape of the inner tray is not limited to any particular shape. It can be square, oval, round, triangular or any other desired shape.

This first preferred embodiment further comprises an outer cover package which encloses the inner tray and the electronic communications device that is being packaged. The outer cover package is preferably a plastic "clam-shell" type cover with two halves connected at one end resembling a clam, with the other end being openable or closeable to insert and remove the inner tray and the slider-type electronic communications device and other packaging materials or elements. In this first preferred embodiment, portion of the outer cover package that fits over the slider-type electronic communications device is also molded to provide a surface that generally or substantially conforms to the shape of the front surface of the slider-type electronic communications device when in the open position. When the slider-type device is placed in the recess formed by the molded upper surface of the inner tray and the outer cover package is closed over the slider-type device with the molded portion of the outer cover package covering the front surface of the slider device, the slider type device is kept securely in place in the open position. The molding or other shaping of the outer cover package generally or substantially conforming to the front surface of the slider device in the open position can be configured to generally or substantially conform to the upper segment of the slider device only, or it can be configured to have a "step" configuration in which the upper "step" portion accepts the upper segment of the slider device and the lower step portion fits over the lower segment of the slider device. The outer cover package can be configured to have a flat or smooth front surface or it can have the section that is molded or is otherwise shaped to accept the front surface of the upper segment of the slider device indented upwardly or downwardly from the outer cover package surface. In embodiments in which the inner tray has a single level recess to accept the back side of the slider device and the outer cover package has a single level recess to accept the front side of the slider device, the recess of the inner tray and the recess of the outer cover package are spaced apart to match the configuration of the slider device when in the open position, such that when the slider device is placed with the back part of the lower segment inserted in the recess of the inner tray and the inner tray is inserted into the outer package with the front surface recess of the outer package placed over the front segment of the slider device, and the outer package is closed, the slider device is securely packaged in the open position and the features of each segment can be viewed through the packaging when the outer cover package used is a clear plastic clamshell package, and the slider device will not be jarred from the open position to the closed position during shipment or while on display in the display package of the present invention. It is to be understood that the molding or other shaping of the contoured surfaces of the inner tray and the outer cover package, and the retainer insert in embodiments using a retainer insert, which contact the surfaces of the slider device when the slider device is inserted in the display package is preferably generally or substantially conforming to the shape of the segments of the slider device in the open position but the level of conformity can vary—the present invention covers varying levels of conformity as long as the slider device is maintained in the open position within the package.

The outer cover package is preferably made of plastic but can be made of other suitable materials known in the art, such as, without limitation, cardboard, styrofoam, pressed paper, fiberglass or other plastic or fibrous materials or combinations of any suitable materials. The outer cover package can also be a single piece component or it can be a multipart component. In a preferred embodiment the outer cover package is a one or two-piece clamshell-style package, or a two piece package with front half and a back half. The components can each be made of the same material or different components can be made from different materials. The outer cover package can also be transparent or opaque. Portions can be transparent while other portions can be opaque. Preferably the portion of the outer tray that is located over the slider-type electronic communications device is transparent, or is an open space, thereby enabling viewing of the slider device in the open position, revealing the features of each segment of the slider device. The shape of the outer cover package is not limited to any particular shape. It can be square, oval, round, triangular or any other desired shape. Preferably the shape of the outer cover package is substantially the same as the shape of the inner tray, and is sized such that the inner tray fits within the outer cover package, preferably in a relatively snug manner to maintain the packaged slider device snugly packaged in the open position during shipment and while on display. Preferably at least the section of the inner tray and the section of the outer cover package which have the recesses to fit the slider phone or other slider-type device fit together relatively snugly to retain the slider device in place and in the open position in the package. Preferably the outer cover package has a lower side surface configured such that the display package can stand upright on its own when placed on a flat surface. In one such preferred configuration the lower side is substantially straight.

In a second preferred embodiment, the upper surface of the inner tray has a section that is configured to provide a recess molded or otherwise shaped to fit the back side of the particular slider-type communications device in the open position in one of the various alternative embodiments for the inner tray described above, which can include a single recess (in which the back side of the lower segment of the slider device fits, and the outer cover package fits over the front surface of the upper segment of the slider device), or a "step" style recess where the lower step accepts the lower segment of the slider device and the upper step receives the upper segment of the slider device, and the outer cover package which encloses the inner tray has a substantially flat or smooth section without requiring a recess to receive and retain in place the front segment of the slider device. In an embodiment using a separate retainer insert and has an outer cover package with a substantially flat or smooth front surface over the area in which the slider device is placed on the inner tray, the retainer element is positioned over the lower segment of the slider-type communications device preferably (although not necessarily) after it is placed in the recess on the front surface of the inner tray. The retainer element resembles a plate or tray, having tapered side-wall surfaces in one embodiment, contoured to fit against the side surfaces of the upper segment of the particular slider-type device and the sides of the inner tray recess that holds the lower segment of the slider device. The retainer insert's tapered side-wall surfaces retain the upper segment of the slider device in the open position by blocking movement of the upper segment of the slider device back toward the lower segment. The retainer insert preferably has side-walls of sufficient height to make retaining contact with the side surfaces of the upper segment of the slider device and also contact the side walls of the recess in the inner tray, and is sized and shaped to fit in (and when deployed is set into) the space over the lower segment of the slider device in the open position, with its sidewalls fitting against the side of the upper segment of the slider device at one side and fitting against the side wall of the recess in the inner tray at the opposite side. The shape of the retainer element is configured to fit over the lower segment of the slider device, and is preferably made of clear plastic so that the lower segment of the slider device and its features can be perceived through the retainer insert when deployed in the display packaging. When the slider phone is placed in the recess of the inner tray in the open position, and the retainer insert is inserted over the lower segment of the slider device in the space of the inner tray where the lower segment of the slider device is disposed, and the inner tray is inserted into the outer cover package and the outer cover package is closed, the slider device is packaged snugly in the open position and will not close during shipment or display in the display packaging. The embodiment that uses a plastic retainer is shown in the figures for a version for a slider phone that slides along its longer side whereas the embodiment that uses a molded inner tray and molded outer cover package with no retainer insert is shown in a version for a slider phone that slides along its shorter side. The retainer insert and the inner tray and outer cover package configurations and contours can be varied to generally or substantially conform to the sliding configuration of the particular sliding device. The other variations discussed above with regard to other embodiments of the present invention can be incorporated into this alternate embodiment as well as into other alternate embodiments.

Referring now to the figures, FIG. 1 is a top front assembled perspective view of the present invention in a preferred embodiment which includes a retainer insert, showing the inner tray 10 having a shaped recess 11 generally or substantially conforming to shape of the back surface of the slider phone 40, with the slider phone 40 resting thereon, the inner tray 10 contained within the outer cover package halves 20 and 22 with the outer cover package halves 20 and 22 in the closed position and the retainer insert 30 installed over the front portion of the inner tray 10 over the front surface of the lower segment 42 of the slider phone 40 and inside of the outer cover package halves 20 and 22. The retainer side wall 32 generally or substantially conforms to and fits against the bottom end of shaped recess 11 and opposite retainer side wall 42 generally or substantially conforms to and fits against the bottom edge of the upper segment 43 of the slider phone 40. A tab 21 on the edge of the outer cover package half 20 helps to separate and open the outer cover package halves 20 and 22. The outer cover package halves 20 and 22 preferably include a slot 23 for hanging of the package.

Figure 2:
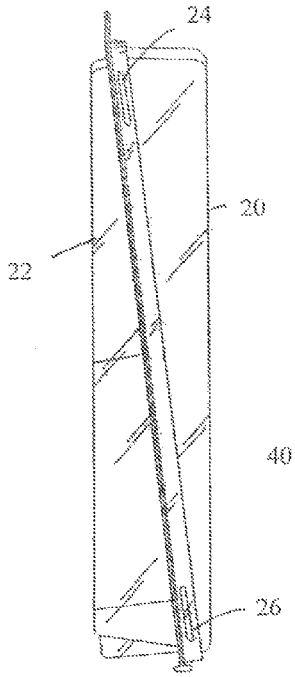
FIG. 2 is a left side elevational view of the present invention in a preferred embodiment utilizing a retainer insert, with the inner tray contained within the outer cover package, depicting a substantially flat outer surface of outer cover package.

FIG. 2 is a left side elevational view of the present invention in a preferred embodiment utilizing a retainer insert 30, with the inner tray 10 contained within the outer cover package halves 20 and 22, depicting a substantially flat outer surface of outer cover package front half 20. Ribs 24 and 26 hold the halves 20 and 22 of outer package together.

Figure 3:
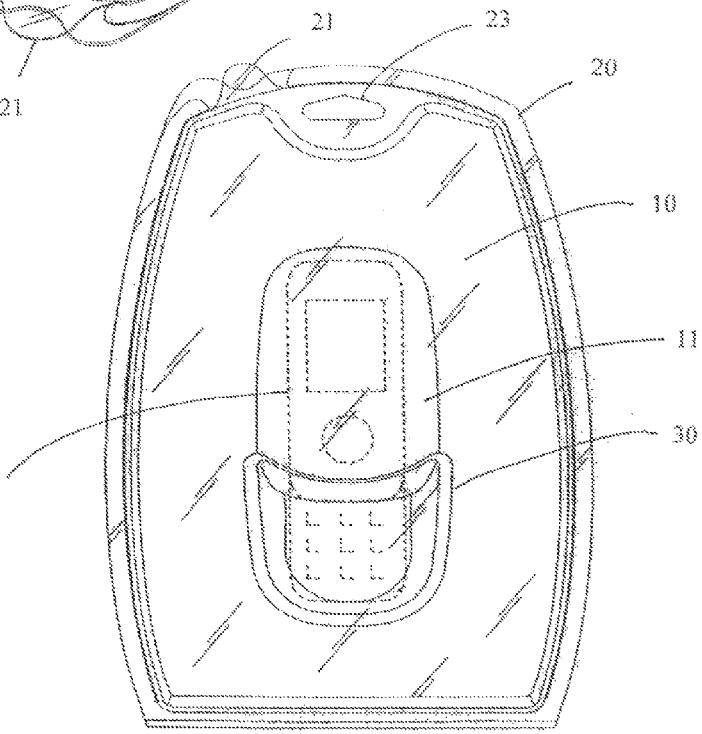
FIG. 3 is a front view of the present invention in a preferred embodiment including a retainer insert deployed between the front surface of the inner tray and the inner surface of the front portion of the outer cover package, positioned over the front surface of the lower segment of the slider device.

FIG. 3 is a front view of the present invention in a preferred embodiment including a retainer insert 30 deployed between the front surface of the inner tray 10 and the inner surface of the front half 20 of the outer cover package positioned over the front surface of the lower segment 42 of the slider device 40.

Figure 4:
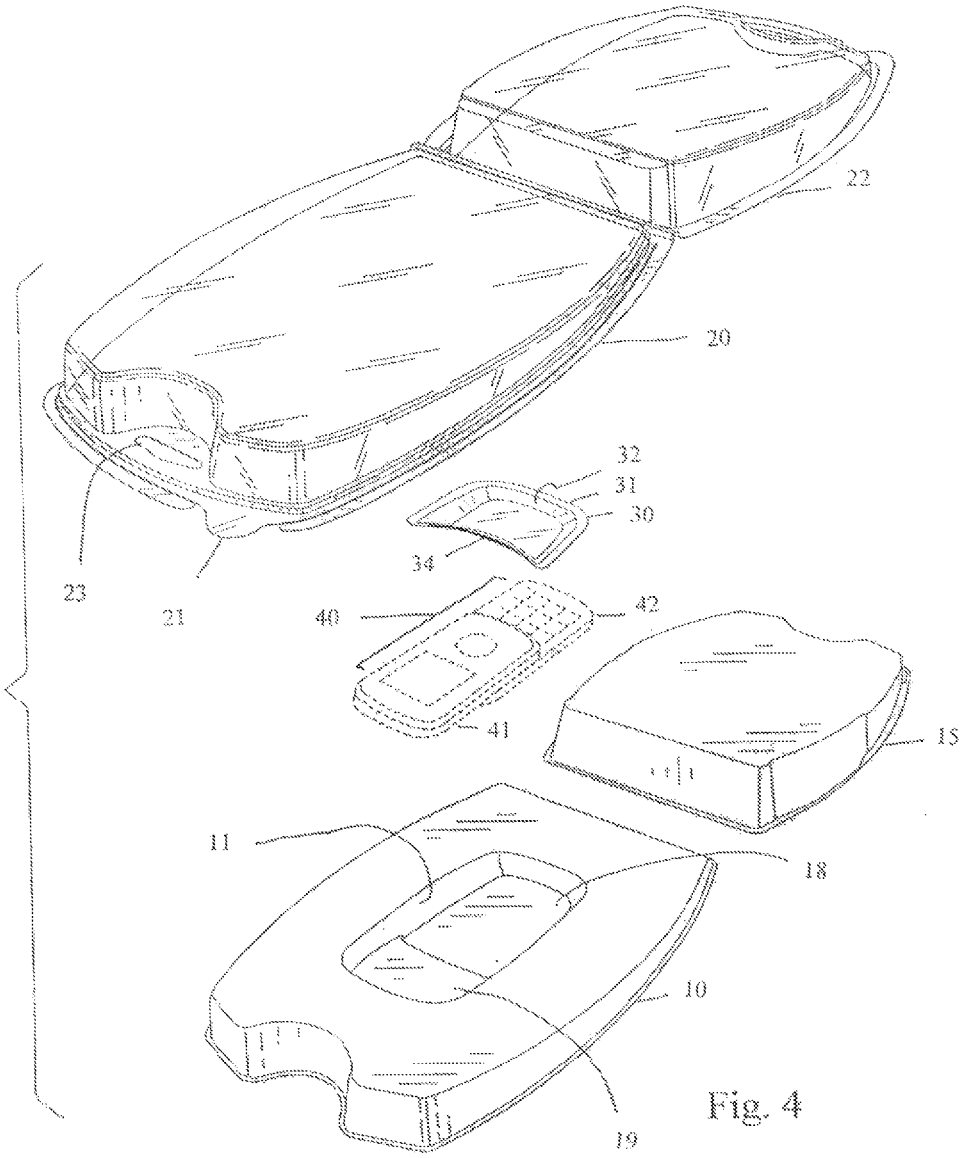
FIG. 4 is an exploded perspective view of the present invention in a preferred embodiment including a retainer insert, showing the outer cover package in a clamshell embodiment in the open position and an exploded view of the inner tray in a two-part embodiment with the molded recess on the front surface shaped to generally or substantially conform to all or part of the back surface of the slider device, the outer cover package having substantially smooth surface at least in the area located over the slider phone when inserted, and also depicting a retainer insert and a sample slider device in the open position.

FIG. 4 is an exploded perspective view of the present invention in a preferred embodiment including a retainer insert 30, showing the outer cover package halves 20 and 22 in a clamshell embodiment in the open position and an exploded view of the inner tray 10 in a two-part embodiment with bottom or back portion 15 and with the molded recess 11 on the front surface shaped to generally or substantially conform to the back surface of the slider device 40, the front side of outer cover package half 20 having substantially smooth surface at least in the area located over the slider phone when inserted, and also depicting a retainer insert 30 and a sample slider device 40 in the open position. Recess 11 is shown in a "step" configuration with a lower surface 18 and upper surface 19 which are configured to receive slider device 40 in the open position, slider segment 42 fitting over lower surface 18 and slider segment 41 fitting over upper surface 19 when slider device 40 is placed in recess 11. Retainer 30 side wall 34 fits against bottom edge of slider device segment 41 and fits over the front surface of slider device segment 42, with side wall 32 fitting against the bottom edge of recess 11.

Figure 5:
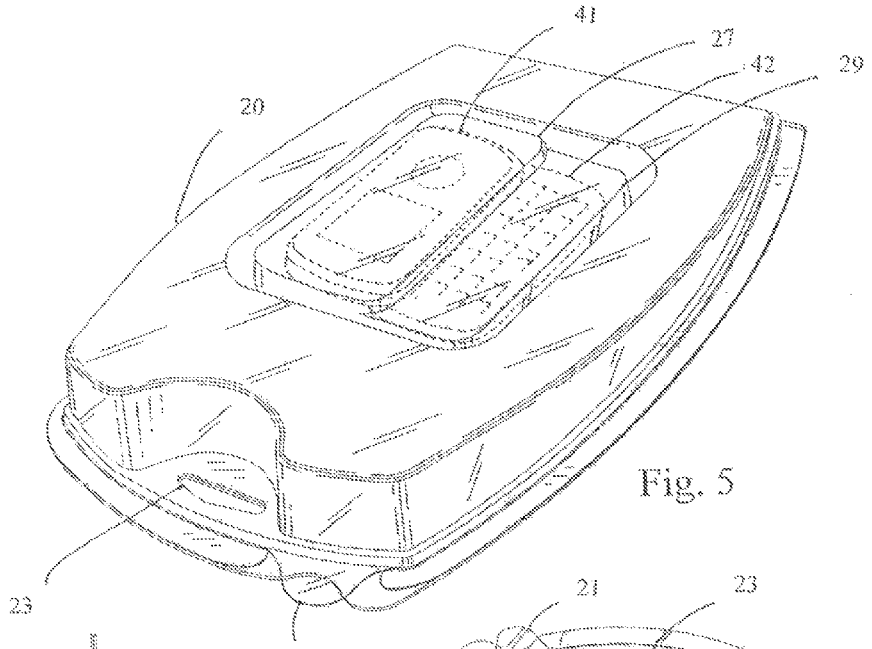
FIG. 5 is a top front assembled perspective view of the present invention in an alternate preferred embodiment comprising an inner tray having a section including a molded recess generally or substantially conforming to all or part of the back surface of the slider device in the open position, and an outer cover package having a section on the front side surface shaped to generally or substantially conform to the front surface of the slider device in the open position, showing the inner tray contained within the outer cover package with outer cover package in closed position, and with a slider phone contained within the outer cover package and packaged securely in the open position by such combination of molded recess of the inner tray section and the molded front section of the outer cover package.

FIG. 5 is a top front assembled perspective view of the present invention in an alternate preferred embodiment comprising an inner tray 10 having a section including a molded recess 11 generally or substantially conforming to all or part of the back surface of the slider device segments 41 and 42 in the open position, and an outer cover package front half 20 having shaped sections 27 and 29 on the front side surface shaped to generally or substantially conform to the front surface of the slider device segments 41 and 42 in the open position, showing the inner tray 10 contained within the outer cover package halves 20 and 22 with outer cover package halves 20 and 22 in closed position, and with a slider device 40 contained within the outer cover package halves 20 and 22 and packaged securely in the open position by such combination of molded recess 11 of the inner tray section 15 and the molded front sections 27 and 29 of the outer cover package.

Figure 6:
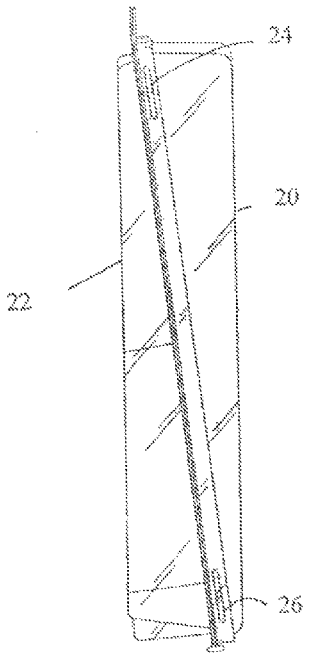
FIG. 6 is a left side elevational view of the present invention in an alternate preferred embodiment comprising an inner tray having a recess shaped to generally or substantially conform to all or part of the back side of the slider phone and an outer cover package having a section molded or otherwise shaped to generally or substantially conform to all or part of the front surface of the slider device in the open position, with the inner tray contained within the outer cover package, depicting a substantially flat outer surface of outer cover package.

FIG. 6 is a left side elevational view of the present invention in said alternate preferred embodiment comprising an inner tray 10 having a recess 11 shaped to generally or substantially conform to all or part of the back side of the slider phone 40 and an outer cover package front half 15 having a section molded or otherwise shaped to generally or substantially conform to all or part of the front surface of the slider device 40 in the open position with the inner tray 10 contained within the outer cover package halves 20 and 22, depicting a substantially flat outer surface of outer cover package front half 20. Ribs 24 and 26 hold the halves 20 and 22 of outer cover package together.

Figure 7:
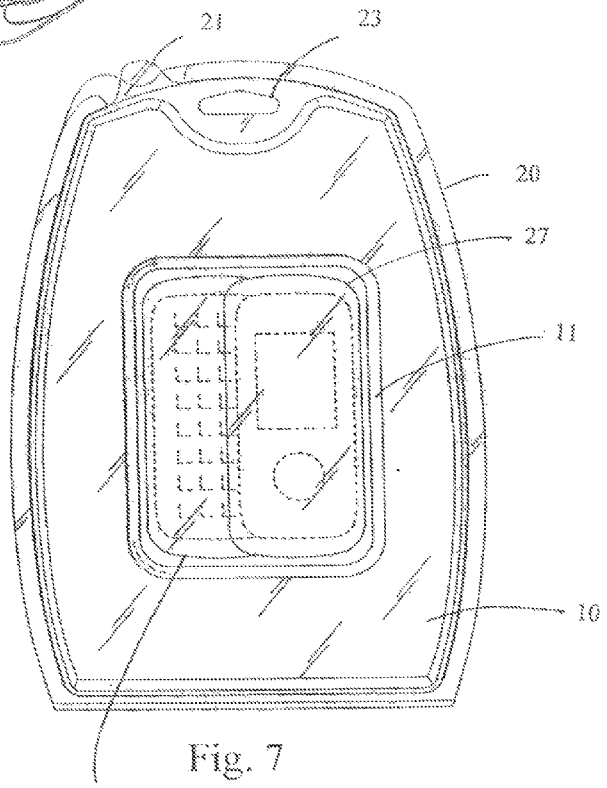
FIG. 7 is a front view of the present invention in an alternate preferred embodiment comprising an inner tray having a recess shaped to generally or substantially conform to all or part of the back side of the slider phone and an outer cover package having a section molded or otherwise shaped to generally or substantially conform to all or part of the front surface of the slider device in the open position, showing the inner tray within the outer cover package, with a sample slider phone placed in the recess provided in the inner tray, with the front inner surface of the shaped outer cover package generally or substantially conforming to all or part of the front surface of the slider device in the open position keeping the slider phone in the open position.

FIG. 7 is a front view of the present invention in an alternate preferred embodiment comprising an inner tray 10 having a recess 11 shaped to generally or substantially conform to all or part of the back side of the slider device 40 and an outer cover package front half 20 having sections 27 and 29 molded or otherwise shaped to generally or substantially conform to all or part of the front surface of the slider device 40 segments 41 and 42 in the open position, showing the inner tray 10 within the outer cover package halves 20 and 22, with a sample slider device 40 placed in the recess 11 provided in the inner tray 10, with the sections 27 and 29 front half 20 of the outer cover package generally or substantially conforming to all or part of the front surface of the slider device 40 sliding segments 41 and 42 in the open position keeping the slider phone 40 in the open position.

Figure 8:
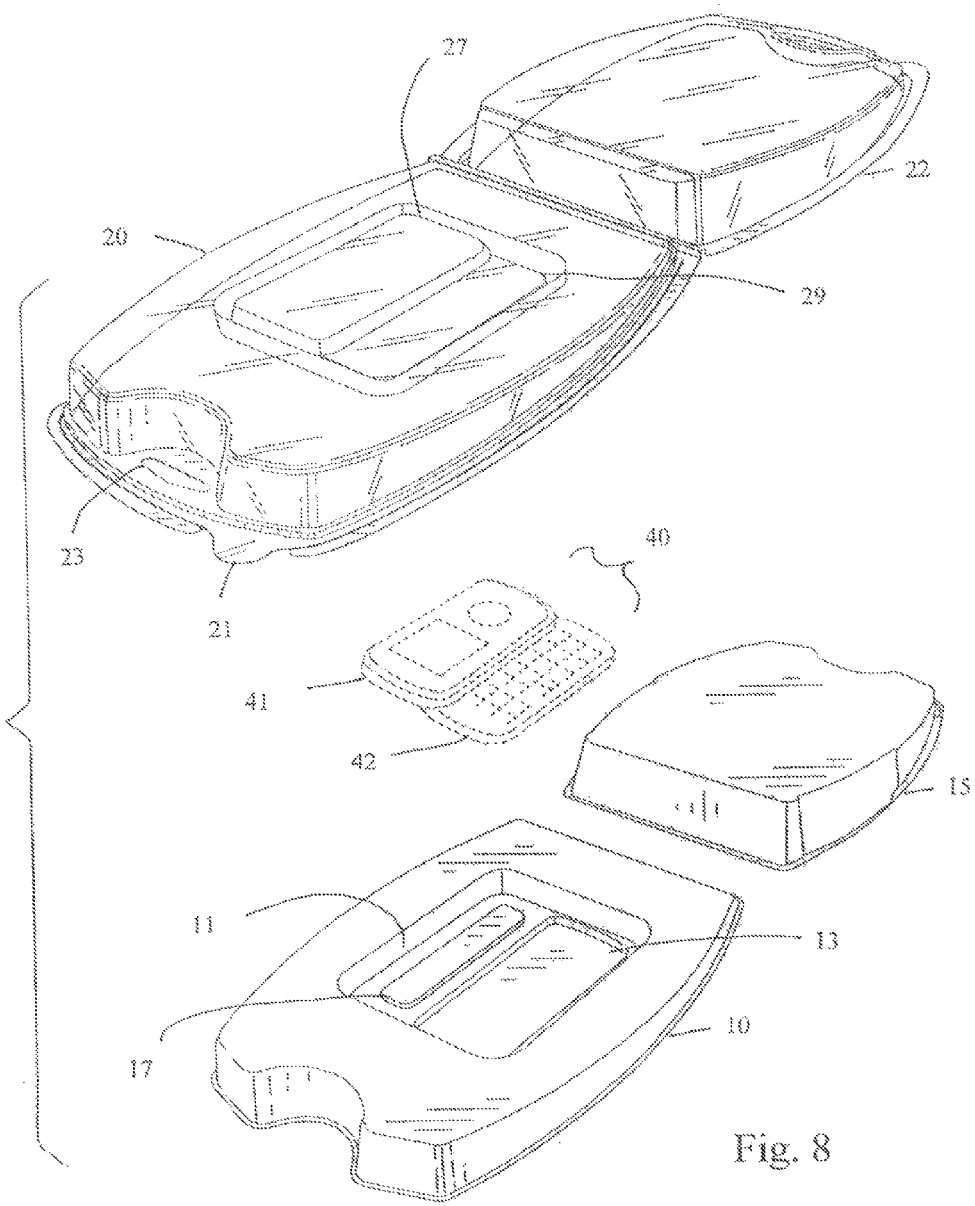
FIG. 8 is an exploded perspective view of the present invention in an alternate preferred embodiment comprising an inner tray having a front surface with a section molded or otherwise shaped recess generally or substantially conforming to all or part of the back surface of a slider phone in the open position for holding the slider phone, and an outer cover package having a front side with a section shaped to generally or substantially conform to all or part of the front side of the slider phone in an open position, to hold the slider phone in the open position when the slider phone is placed in the open position in the recess of the inner tray and the inner tray is placed within the outer cover package and the outer cover package is closed over the inner tray and the slider phone such that the integral retainer formed by the contour of the outer cover package rests against the front surface of the slider phone in the open position. The outer cover package is depicted in a clamshell embodiment in the open position and the exploded view of inner tray depicts a two piece embodiment of the inner tray, showing the shaped recess in the front surface of the inner tray for holding the back surface of the slider phone, and the shaped inner surface of the outer cover package which is molded or otherwise shaped to generally or substantially conform to all or part of the front surface of the slider device in the open position keeping the slider phone in the open position when the slider phone is placed in the open position within the recess of the inner tray and the inner tray is placed within the outer cover package with the shaped front inner surface generally conforming to all or part of the front surface of the slider device in the open position is positioned over the slider phone, and the outer cover package is closed.

FIG. 8 is an exploded perspective view of the present invention in an alternate preferred embodiment comprising an inner tray 10 having a front surface with a recess 11 having sections 13 and 17 molded or otherwise shaped recess generally or substantially conforming to all or part of the back surface of a slider device 40 sliding segments 41 and 42 in the open position for holding the slider phone 40, and outer cover package halves 20 and 22 with half 20 having a front side with sections 27 and 29 shaped to generally or substantially conform to all or part of the front side of the slider device 40 sliding segments 41 and 42 in an open position, to hold the slider device 40 in the open position when the slider device 40 is placed in the open position in the recess 11 of the inner tray 10 and the inner tray 10 is placed within the outer cover package halves 20 and 22 and the outer cover package halves 20 and 22 are closed over the inner tray 10 and the slider phone 40 such that the contours of sections 27 and 29 of the outer cover package half 20 rest against the front surface of the slider phone 40 in the open position. The outer cover package halves 20 and 22 are depicted in a clamshell embodiment in the open position and the exploded view of inner tray 10 depicts a two piece embodiment of the inner tray with back half 15, showing the shaped recess 11 in the front surface of the inner tray 10 "step" sections 13 and 17 for receiving and holding the back surface of the slider phone 40 sliding segments 41 and 42, and the shaped inner surface of sections 27 and 29 of outer cover package front half 20 which are molded or otherwise shaped to generally or substantially conform to all or part of the front surface of the slider device 40 in the open position keeping the slider phone 40 in the open position when the slider phone 40 is placed in the open position within the recess 11 of the inner tray 10 and the inner tray 10 (with back half 15 coupled thereto) is placed within the outer cover package halves 20 and 22 with the shaped front sections 27 and 29 is positioned over the slider phone 40, and the outer cover package halves 20 and 22 are closed.

Figure 9:
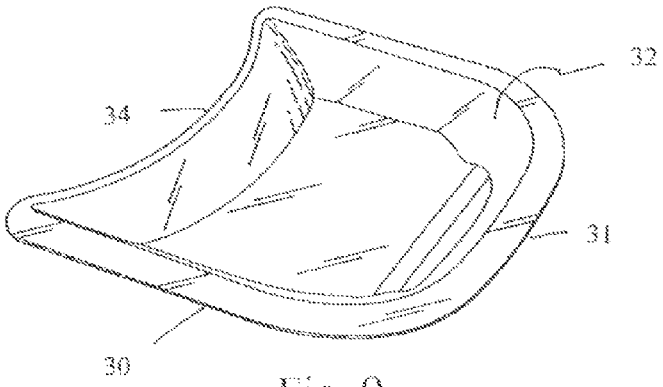
FIG. 9 is a top perspective view of one embodiment of the retainer insert depicting preferably contoured surfaces and sidewalls.

FIG. 9 is a top perspective view of one embodiment of the retainer insert 30 depicting preferably contoured surfaces and sidewalls 32 and 34 and top edge 31.

Figure 10:
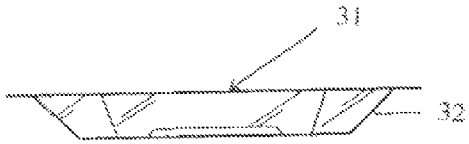
FIG. 10 is a front side perspective view of one embodiment of the retainer insert.

FIG. 10 is a front side perspective view of one embodiment of the retainer insert 30 showing tapered sidewall 32 which generally conforms to edge of recess 11 and top edge 31.

Figure 11:
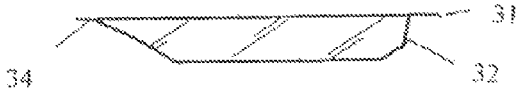
FIG. 11 is a side perspective view of one embodiment of the retainer insert.

FIG. 11 is a side perspective view of one embodiment of the retainer insert 30 showing upper edge 31 and tapered sidewalls 32 and 34 contoured to generally conform to edge of recess 11 and slider segment 41. Upper edge 31 overlaps the front surface of recess 11 and also contacts the inner surface of outer cover package front half 20, which helps to keep retainer insert 30 in place.

Figure 12:
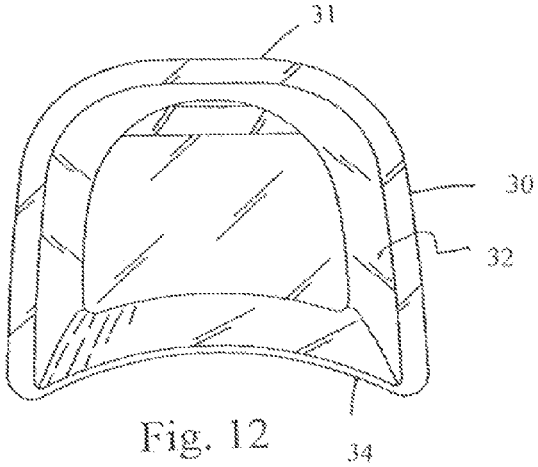
FIG. 12 is a top view of one embodiment of the retainer insert.

FIG. 12 is a top view of one embodiment of the retainer insert 30 showing sidewalls 32 and 34 and upper edge 31 of sidewalls.

The foregoing discussion of preferred embodiments refers to slider-type devices that have two sliding segments, but the present invention is not limited to such devices and can be used with slider-type devices that have more than two segments by molding the inner tray and outer cover package to generally or substantially conform to the shape of the device to be packaged in one preferred embodiment, and in another preferred embodiment, by providing a retainer insert that is configured to retain the segments in place in the open position. In some such embodiments, more than one retainer insert may be used, or a single retainer insert molded to generally or substantially conform to the shape of and retain two or more sliding segments can be utilized. The display packaging of the present invention keeps the slider-type device securely packaged in the open position during shipment as well as when on display at point of sale locations, thereby permitting all segments of the slider-type device and the slider functionality to be viewed and appreciated by consumers.

While the present invention has been shown and described herein in what is considered to be a preferred embodiment there of, illustrating the results and advantages over the prior art obtained through in the present invention, the invention is not limited to the specific embodiments described above. Thus, the forms of the invention shown and described herein are to be taken as illustrative and other embodiments may be selected without departing from the spirit and scope of the present invention.

What is claimed is:

1. A display package configured for packaging of a slider type electronic communications device, the slider type electronic communications device having a first surface and a second surface that are slidable apart from each other, and a third surface and a fourth surface that are on an opposite side of the first surface and the second surface, the display package comprising:

an inner tray having a front surface with a recess thereon having a lower surface and an upper surface, wherein the lower surface and the upper surface are in a step configuration wherein the upper surface conforms to the first surface of the slider type electronic communications device and the lower surface conforms to the second surface of the slider type electronic communications device;

an outer cover package having a contoured front surface with a lower surface and an upper surface in a step configuration wherein the lower surface conforms to the third surface of the slider type electronic communications device and the upper surface conforms to the fourth surface of the slider type electronic communications device; and said inner tray being enclosable within said outer cover package with said recess of said inner tray.

2. The display packaging of claim 1, wherein said contoured front surface of said outer cover package is transparent.

3. The display package of claim 1, wherein said inner tray comprises a top half section and a bottom half section, said top half section and said bottom half section having compatible edges for coupling to each other and said top half section and said bottom half section enclose a space wherein product literature and additional product components can be packaged.

4. A display package configured for packaging a slider type electronic communications device, the slider type electronic communications device having a first surface and a second surface that are slidable apart from each other, and a third surface and a fourth surface that are on an opposite side of the first surface and the second surface, the display package comprising:

an inner tray having a front surface with a recess with an upper surface and a lower surface, wherein the upper surface and the lower surface are in a step configuration wherein the upper surface conforms to the first surface of the slider type electronic communications device and the lower surface conforms to the second surface of the slider type electronic communications device;

an outer cover package for enclosing said inner tray and having a front section configured to be arranged over the recess of the inner tray, said outer cover package encloses said inner tray, and a retainer insert having an outer cover positioned over the lower surface of the recess of the inner tray, configured to maintain the slider type electronic communications device in an open position, and arranged between the front surface of the outer cover package and the front surface of the inner tray.

5. The display packaging of claim 4, wherein said front section of said outer cover package is configured to be located over the recess of the inner tray, and said front section is transparent.

6. The display packaging of claim 4, wherein said front section of said outer cover package is configured to be located over a slider type electronic communications device when the slider type electronic communications device is inserted therein, said front section being made of plastic material.

7. The display packaging of claim 4, wherein said retainer insert is configured to be placed over a front surface of a first sliding segment of the slider type electronic communications device, said retainer insert being transparent.

8. The display packaging of claim 4, wherein said retainer insert is made of plastic material.

9. The display package of claim 4, wherein said front section of said outer cover package is substantially flat.

10. The display package of claim 4, wherein said inner tray comprises a top half section and a bottom half section, said top half section and said bottom half section having compatible edges for coupling to each other and said top half section and said bottom half section are configured to enclose a space wherein product literature and additional product components can be packaged.

11. A display package configured for packaging of a slider type electronic communications device in an open position, said display package comprising:

an inner tray having a lower surface and an upper surface, wherein the lower surface and the upper surface are in a step configuration wherein the upper surface conforms to a first surface of the slider type electronic communications device and the lower surface conforms to a second surface of the slider type electronic communications device;

an outer cover package having a flat front side portion positioned to cover said upper surface of said inner tray so as to secure an upper portion of the slider type electronic communications device, and positioned to cover said lower surface of said inner tray so as to secure a lower portion of the slider type electronic communications device; and said inner tray being configured to be enclosable within said outer cover package such that the slider type electronic communications device would be retained in the open position, and said inner tray is enclosed within said outer cover package.

12. A display package configured for packaging a slider type electronic communications device in an open position, the display package comprising:

an inner tray having a front surface with a recess having a lower surface and an upper surface, wherein the lower surface and the upper surface are in a step configuration wherein the upper surface conforms to a first surface of the slider type electronic communications device and the lower surface conforms to a second surface of the slider type electronic communications device;

an outer cover package; and a retainer insert having an outer cover positioned over the lower surface of the recess of the inner tray, configured to maintain the slider type electronic communications device in the open position, and arranged between the outer cover package and the front surface of the inner tray.

13. The display packaging of claim 12, wherein said retainer insert has tapered sidewalls forming a tray-like structure.

14. The display packaging of claim 12, wherein said outer cover package has a clam-shell configuration.

* * * * *